US011016439B2

(12) United States Patent
Hu et al.

(10) Patent No.: US 11,016,439 B2
(45) Date of Patent: May 25, 2021

(54) PROCESS CARTRIDGE

(71) Applicant: JIANGXI YIBO E-TECH CO., LTD., Xinyu (CN)

(72) Inventors: Lianglaing Hu, Xinyu (CN); Shiping Ao, Xinyu (CN); Mingsheng Zhao, Xinyu (CN); Sheng Yang, Xinyu (CN); Fei Hu, Xinyu (CN); Junliang Qiu, Xinyu (CN)

(73) Assignee: JIANGXI YIBO E-TECH CO., LTD., Xinyu (CN)

( * ) Notice: Subject to any disclaimer, the term of this patent is extended or adjusted under 35 U.S.C. 154(b) by 0 days.

(21) Appl. No.: 16/886,006

(22) Filed: May 28, 2020

(65) Prior Publication Data

US 2020/0301356 A1 Sep. 24, 2020

Related U.S. Application Data

(63) Continuation of application No. PCT/CN2018/117774, filed on Nov. 28, 2018.

(30) Foreign Application Priority Data

Nov. 30, 2017 (CN) ..... 201721638864.1
Nov. 30, 2017 (CN) ..... 201721638906.1
(Continued)

(51) Int. Cl.
*G03G 21/18* (2006.01)
*G03G 21/16* (2006.01)

(52) U.S. Cl.
CPC ..... *G03G 21/1857* (2013.01); *G03G 21/1647* (2013.01); *G03G 2221/1657* (2013.01)

(58) Field of Classification Search
CPC ..... G03G 15/757; G03G 21/1647; G03G 21/1857; G03G 2221/1657
See application file for complete search history.

(56) References Cited

U.S. PATENT DOCUMENTS 5,983,055 A 11/1999 Bito et al.
10,539,915 B2 * 1/2020 Mori ..... G03G 21/1647
(Continued)

FOREIGN PATENT DOCUMENTS

CN 1728006 A 2/2006
CN 202904225 U 4/2013
(Continued)

OTHER PUBLICATIONS

Search Report of PCT/CN2018/117774.
Written opinion of PCT/CN2018/117774.

*Primary Examiner* — Sophia S Chen
(74) *Attorney, Agent, or Firm* — Dragon Sun Law Firm, PC

(57) ABSTRACT

There is provided a process cartridge that includes a driving assembly engageable with a driving shaft having a recess in an image forming apparatus. The driving assembly includes a coupling member, configured to receive a driving force from the driving shaft and provided with a power receiving portion engageable with the recess of the driving shaft; and a body portion capable of rotating after receiving the driving force transmitted by the power receiving portion. When the driving assembly is mounted in the image forming apparatus, the power receiving portion can urge the axis of the driving shaft to be inclined with respect to the axis of the driving assembly. The coupling member urges the driving shaft to be inclined to implement engagement and disengagement, thus solving the technical problem in the prior art that the driving assembly has complicated molding process, high production costs and unstable transmission of the driving force.

15 Claims, 13 Drawing Sheets

5

3

(30) Foreign Application Priority Data

Sep. 25, 2018 (CN) ..... 201821559464.6
Sep. 27, 2018 (CN) ..... 201821582479.4

(56) References Cited

U.S. PATENT DOCUMENTS

| | | | | |
|---|---|---|---|---|
| 10,671,013 | B2 * | 6/2020 | Uesugi | G03G 21/1647 |
| 2016/0231688 | A1 * | 8/2016 | Huang | G03G 15/757 |

FOREIGN PATENT DOCUMENTS

| | | | |
|---|---|---|---|
| CN | 203503738 | U | 3/2014 |
| CN | 104765257 | A | 7/2015 |
| CN | 205229681 | U | 5/2016 |
| CN | 205827076 | U | 12/2016 |
| CN | 106610576 | A | 5/2017 |
| CN | 207601522 | U | 7/2018 |
| CN | 207601523 | U | 7/2018 |
| WO | 2016088303 | A1 | 6/2016 |
| WO | 2016137014 | A1 | 9/2016 |

* cited by examiner

PROCESS CARTRIDGE

CROSS-REFERENCE TO RELATED APPLICATIONS

This application is a bypass continuation application of PCT Application No. PCT/CN2018/117774. This Application claims priority from PCT Application No. PCT/CN2018/117774, filed Nov. 28, 2018, and CN Application No. 201721638906. 1, filed Nov. 30, 2017, CN Application No. 201721638864. 1, filed Nov. 30, 2017, CN Application No. 201821559464.6, filed Sep. 25, 2018, CN Application No. 201821559464.6, filed Sep. 25, 2018, CN Application No. 201821582479.4, filed Sep. 27, 2018, the contents of which are incorporated herein in the entirety by reference.

Some references, which may include patents, patent applications, and various publications, are cited and discussed in the description of the present invention. The citation and/or discussion of such references is provided merely to clarify the description of the present invention and is not an admission that any such reference is "prior art" to the present invention described herein. All references cited and discussed in this specification are incorporated herein by reference in their entireties and to the same extent as if each reference were individually incorporated by reference.

TECHNICAL FIELD

The present invention relates to a process cartridge that is utilized in an image forming apparatus.

BACKGROUND

A process cartridge is a cartridge detachably mounted into an image forming apparatus. As an integral unit, the cartridge includes one electro-photographic photosensitive assembly and at least one of processors such as a charger, a developing device and a cleaner. Because the process cartridge is detachably mounted relative to the body of the image forming apparatus, the image forming apparatus can be conveniently serviced. The image forming apparatus employing an electro-photographic imaging manner works in such a way that the electro-photographic photosensitive assembly uniformly charged by the charger is subject to selective exposure through light of the image forming apparatus to form an electrostatic latent image, which is developed into a toner image through a toner utilized by the developing device and the toner image is then transferred to a recording medium by a transfer device so that an image is formed on a recording material.

In the prior art, for example, a Chinese Taiwan patent No. TW201633019A discloses a process cartridge including a driving assembly driving a photosensitive drum to rotate. The driving assembly has a wheel hub and a power receiving portion connected with the wheel hub through a deformable connecting portion. A driving shaft is disposed in the image forming apparatus and recesses engageable with the power receiving portion are arranged circumferentially on the driving shaft. When the process cartridge is mounted into the image forming apparatus, a front end of the driving shaft directly squeezes the power receiving portion to deform the connecting portion and goes over the power receiving portion so that the power receiving portion finally is engaged with the recess to achieve transmission of driving force. However, because the wheel hub and the power receiving portion are connected only by the thin and deformable connecting portion in the above driving assembly, the power receiving portion may damage the connecting portion when transmitting the driving force to the wheel hub, thereby resulting in inability to transmit the driving force.

Further, a metal material is required to be added to the thin and deformable connecting portion during a molding process so as to increase a torsion strength bearable for the driving assembly. Due to the complex molding process, the production costs of the driving assembly are increased.

Therefore, a heretofore unaddressed need exists in the art to address the aforementioned deficiencies and inadequacies.

SUMMARY

In order to solve the technical problems of complex molding process, high production costs and unstable transmission of the driving force of the driving assembly in the prior art, the present invention provides the following technical solution.

There is provided a process cartridge detachably mounted in an image forming apparatus having a driving shaft. The driving shaft includes a closed front end and a plurality of recesses arranged on a circumferential surface of the driving shaft. The process cartridge includes:

a driving assembly including a body portion and a coupling member connected with the body portion.

The coupling member may engage with the driving shaft to receive a driving force.

The coupling member has a pressing portion and a power receiving portion, and the pressing portion is pressed by the front end to drive the power receiving portion to move to engage with the recess.

Further, the coupling member rotates around a rotation center, and the pressing portion and the power receiving portion are disposed at both sides with respect to the rotation center.

Further, the coupling member is mounted on the driving assembly through a connecting pin and the coupling member rotates around the connecting pin.

Further, the driving assembly further includes one pair of oppositely-disposed mounting ribs and the coupling member is mounted in a space formed by the pair of mounting ribs.

Further, the driving assembly further includes a limiting portion for limiting outward rotation of the power receiving portion.

Further, when the pressing portion is pressed by the front end to allow the power receiving portion to be abutted against the circumferential surface of the driving shaft during the process of mounting the process cartridge in the image forming apparatus, the power receiving portion enters the recess and engages with the recess through rotation of the driving shaft.

Further, the power receiving portion has an inner-side guiding portion, and the inner-side guiding portion is abutted against a closed end, close to the front end, of the recess of the driving shaft to urge the power receiving portion to rotate and disengage from the driving shaft when the process cartridge is removed from the image forming apparatus.

Further, the driving assembly further includes a supporting bottom plate mounted on the body portion and the coupling member is movably mounted on the supporting bottom plate.

Further, three coupling member mounting portions are arranged in an equal distance along a circumferential direction of the supporting bottom plate and the three coupling members are mounted on the coupling member mounting portions, respectively.

Further, the body portion is fixedly connected with a photosensitive drum in the process cartridge and the coupling member transmits the driving force to the body portion through the supporting bottom plate so as to rotate the photosensitive drum.

Further, the driving assembly further includes a supporting bottom plate and an elastic member, one end of the elastic member is abutted against the supporting bottom plate and the other end is abutted against the coupling member.

Further, the body portion includes a hollow portion accommodating the driving shaft, and the elastic member urges the power receiving portion to abut against an inner side wall of the hollow portion during the process of mounting the process cartridge in the image forming apparatus.

Further, the coupling member is substantially of an L shape and the pressing portion and the power receiving portion are located on both ends of the L shape, respectively.

Further, the body portion includes a hollow portion accommodating the driving shaft, and the power receiving portion locates in a region formed between an inner wall of the hollow portion and the driving shaft when the power receiving portion and the driving shaft are engaged.

With the above technical solution, the driving assembly according to the present invention will not have a thin structure locally, and the molding process of the driving assembly becomes simple without the complex processing technique of including metal pieces in plastic pieces. In this way, processing and forming difficulty of the driving assembly is greatly reduced, and the stability of the power transmission of the driving assembly is improved. Therefore, the technical problems of complex molding process, high production costs and unstable transmission of the driving force of the driving assembly in the prior art are solved.

BRIEF DESCRIPTION OF THE DRAWINGS

The accompanying drawings illustrate one or more embodiments of the present invention and, together with the written description, serve to explain the principles of the present invention. Wherever possible, the same reference numbers are used throughout the drawings to refer to the same or like elements of an embodiment.

To describe the technical solution of the embodiments of the present invention or the prior art more clearly, accompanying drawings required in the descriptions of the embodiments or the prior art will be briefly introduced below. It is apparent that the accompanying drawings in the following descriptions are merely some embodiments and other drawings may also be obtained by those skilled in the art based on these drawings without paying creative work.

DETAILED DESCRIPTION OF THE EMBODIMENTS

Figure 1:
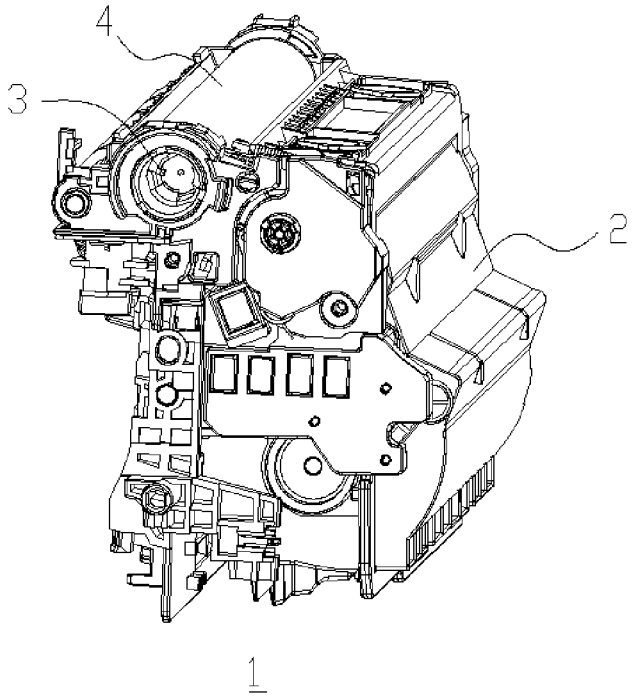
FIG. 1 is a schematic diagram illustrating a structure of a process cartridge according to a first embodiment of the present invention.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that the present invention is thorough and complete, and will fully convey the scope of the present invention to those skilled in the art. Like reference numerals refer to like elements throughout.

To make the object, technical solutions, and advantages of the embodiments of the present invention clearer, the technical solutions in the embodiments of the present invention will be clearly and fully described below in combination with the accompanying drawings in the embodiments of the present invention. Apparently, the described embodiments are merely some embodiments of the present invention rather than all embodiments. All other embodiments obtained by those skilled in the art based on the embodiments of the present invention without paying creative work shall fall within the scope of protection of the present invention.

The First Embodiment

FIG. 1 is a schematic diagram of a structure of a process cartridge 1 according to an embodiment of the present invention. The process cartridge 1 includes a housing 2 storing developer, a photosensitive drum 4 rotatably supported on the housing 2, and a driving assembly 3 mounted at a longitudinal end of the photosensitive drum 4 to receive a driving force transmitted by an image forming apparatus and drive the photosensitive drum 4 to rotate.

Figure 2:
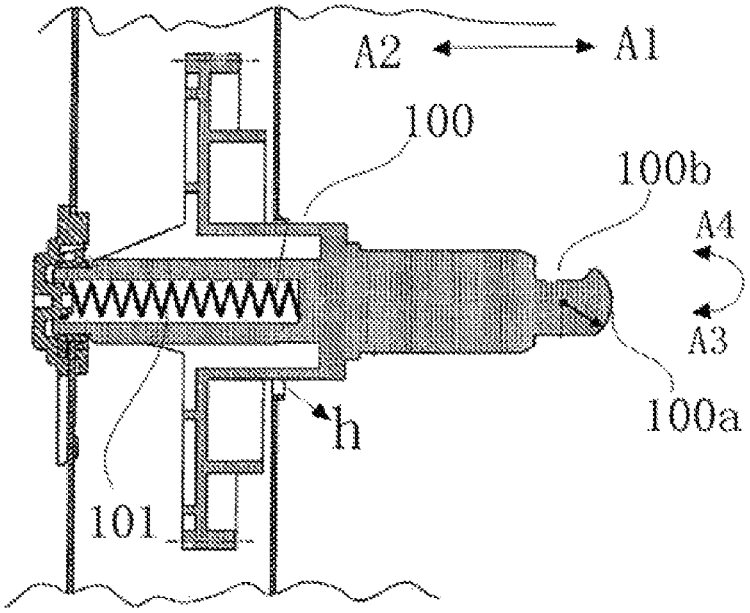
FIG. 2 is a schematic diagram illustrating a structure of a driving shaft in an image forming apparatus in the prior art.

FIG. 2 is a schematic diagram of a structure of a driving shaft 100 of an image forming apparatus in the prior art. The driving shaft 100 is substantially of a cylindrical shape and three uniformly distributed recesses 100*b* (only one is shown) are arranged on a circumferential surface of the driving shaft 100. One end of the driving shaft 100 is connected with an elastic member 101 so that the driving shaft 100 may move toward A1 along an axial direction or retract toward A2 under the action of the elastic force of the elastic member 101. A gap h exists between the driving shaft 100 and a frame of the image forming apparatus along a direction perpendicular to the axial direction. When the driving shaft 100 receives an outer force perpendicular to the axial direction, the driving shaft 100 may be inclined relative to the axial direction along A3 or A4. When the process cartridge 1 is mounted in the image forming apparatus along a direction substantially parallel to an axis of the photosensitive drum, the driving assembly 3 and the driving shaft 100 may cooperate to drive the photosensitive drum to rotate in the cooperation process which will be detailed below.

Figure 3:
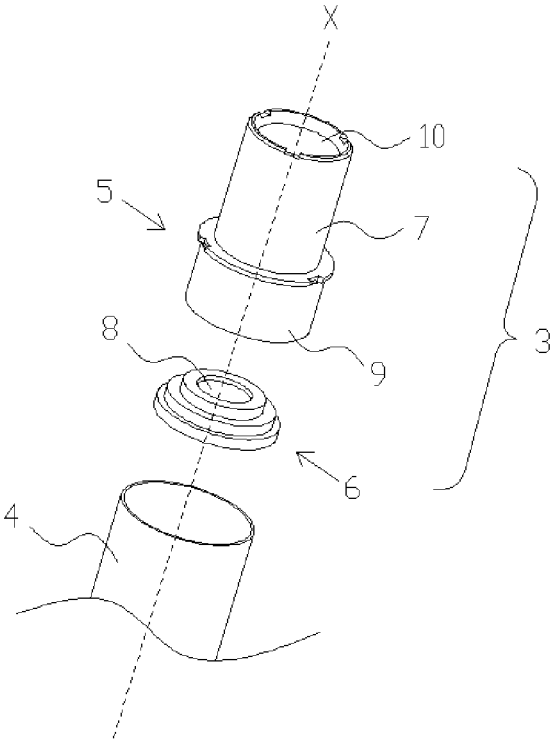
FIG. 3 is an exploded diagram of a structure of a driving assembly according to the first embodiment of the present invention.
Figure 4:
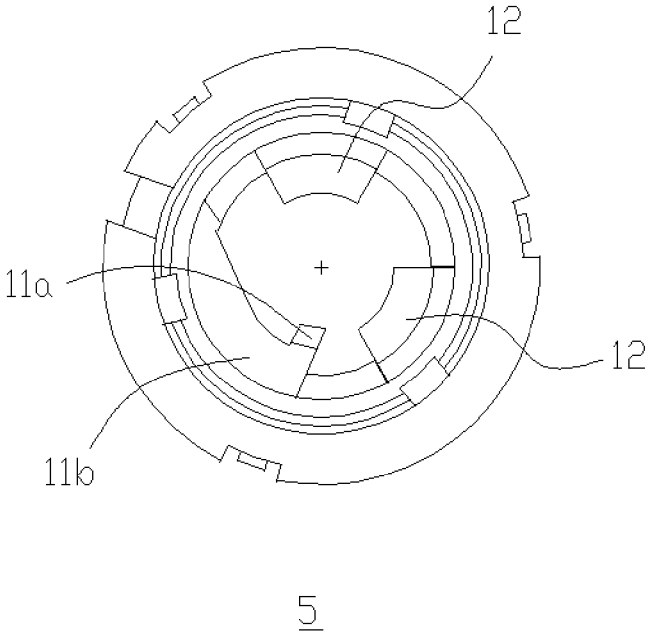
FIG. 4 is a top view of the structure of the driving assembly according to the first embodiment of the present invention.
Figure 5:
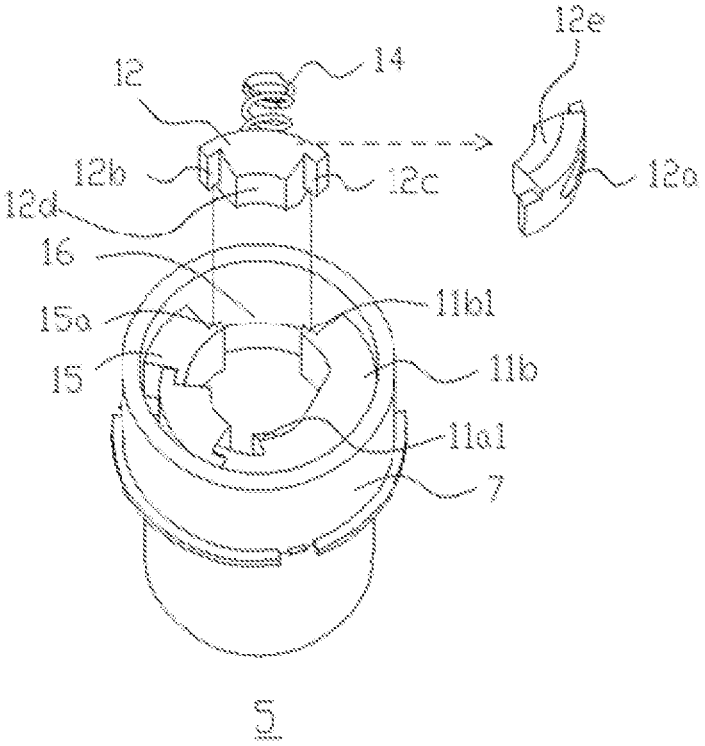
FIG. 5 is a mounting diagram of an urging portion of a coupling member according to the first embodiment of the present invention.

In a preferred embodiment, as shown in FIGS. 3-5, the driving assembly 3 in the embodiment includes a coupling member 5 and a position member 6. The coupling member 5 is substantially of a cylindrical shape and may engage with the driving shaft 100 in the image forming apparatus to receive and transmit a driving force to the photosensitive drum 4; the coupling member 5 and the photosensitive drum 4 share the same axis substantially. The coupling member 5 includes a body portion 7, a power receiving portion 11*a*, a supporting portion 11*b* and an urging portion 12. The body portion 7 is of a hollow cylindrical shape and has a first end 9 and a second end 10 in the direction of the axis X. An outer circumferential surface of the first end 9 may be inserted into an inner wall of a drum body of the photosensitive drum 4 so that the coupling member 5 is mounted to the photosensitive drum 4 through interference fit. Generally, to avoid a loose contact between the coupling member 5 and the photosensitive drum 4, a proper amount of adhesive may be applied to the outer circumferential surface of the first end 9 to make the coupling member 5 and the inner wall of the drum cylinder of the photosensitive drum 4 have a better contact. The second end 10 is a part of the coupling member 5 protruding out of the drum cylinder of the photosensitive drum 4. The supporting portion 11*b* is configured as a supporting plate protruding radially toward the axis X from an inner wall of the body portion 7, and the power receiving portion 11*a* is configured as a hook-shaped portion protruding toward the axis X from the supporting portion 11*b*. The power receiving portion 11*a* and the supporting portion 11*b* are both made of a rigid material and formed integrally with the body portion 7, so that they cannot move relative to the body portion 7. The urging portion 12 is detachably mounted in the body portion 7. Specifically, the body portion 7 is internally provided with a protrusion 15 protruding toward the axis X along a radial direction from the inner wall of the body portion 7, the protrusion 15 is integrally formed with the body portion 7, an opening 16 is arranged between the protrusion 15 and the supporting portion 11*b*, and the urging portion 12 may be mounted in the opening 16. In the embodiment, two urging portions 12 are specifically configured and asymmetrically disposed on the body portion 7 relative to a circumferential direction. A mounting hole 12*a*, a first limiting portion 12*b* and a second limiting portion 12*c* are formed on the urging portion 12, and an elastic component 14 is mounted in the mounting hole 12*a*. When the urging portion 12 is mounted in the opening 16, an end of the elastic component 14 is abutted against the inner wall of the body portion 7 and the other end is abutted in the mounting hole 12*a*. Therefore, the urging portion 12 may move along a radial direction under the action of the elastic component 14. To limit the radial moving amount of the urging portion 12, an end of the protrusion 15, which forms the opening 16 is provided with a first extension 15*a* and an end of the supporting portion 11*b*, which forms the opening 16 is provided with a second extension 11*b*1. A space is formed between the first extension 15*a* and the second extension 11*b*1 along the radial direction. In this case, the first limiting portion 12*b* and the second limiting portion 12*c* can only move in the space so as to limit the radial moving amount of the urging portion 12.

The position member 6 is substantially configured as a boss shape and may be mounted at the first end 9 of the coupling member 5. The position member 6 is connected with the first end 9 of the coupling member 5 by use of adhesive or a fastener and so on and stably mounted in the inner wall of the cylinder of the first end 9, so as to seal an axial end of the first end 9 of the coupling member 5. In the embodiment, the position member 6 may be directly fastened to the axial end of the first end 9 through interference fit so that the position member 6 is mounted on the coupling member 5. A position groove 8 is formed on the position member 6. In combination with FIG. 2, descriptions will be made below on how the position member 6 limits and positions the axial movement of the driving shaft 100 of the image forming apparatus. A front end 100*a* of the driving shaft 100 in the image forming apparatus is of a conic shape and the position groove 8 of the position member 6 receives and accommodates the front end 100*a* of the driving shaft 100. Because the position member 6 is fixed in the process cartridge, the position member will not move. Therefore, during the process of driving force transmission, the driving shaft 100 has a tendency of moving toward a side of the position member 6 under the action of the elastic member 101. Because the front end 100*a* of the driving shaft 100 is abutted against the position groove 8, the position groove 8 limits the axial movement of the driving shaft 100. In the embodiment, the driving assembly 3 is provided with the position member 6 to make the driving force transmission more stable. Alternatively, the position member 6 may also be omitted.

Descriptions will be made below to engagement and disengagement of the driving assembly 3 in the embodiment and the driving shaft 100 in the image forming apparatus in combination with FIGS. 5-8.

Figure 6:
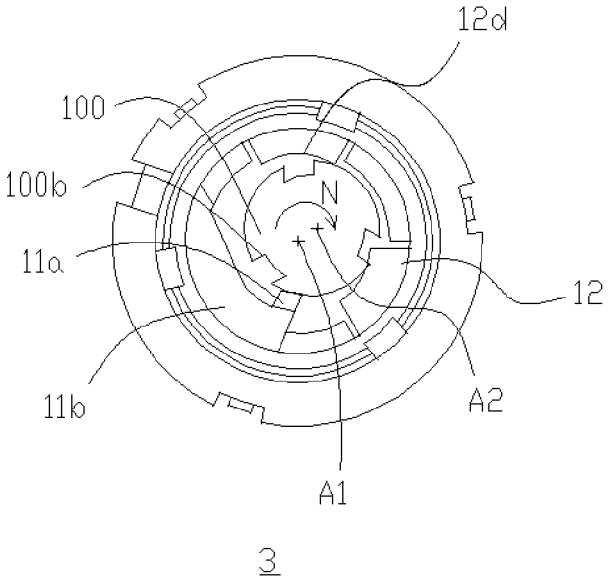
FIG. 6 is a schematic diagram illustrating a first state of an engagement process of the driving assembly and a driving shaft in an image forming apparatus according to the first embodiment of the present invention.
Figure 7:
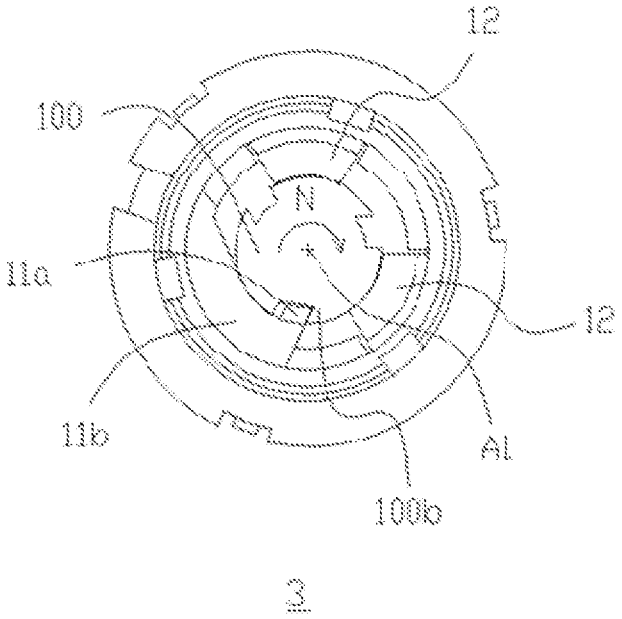
FIG. 7 is a schematic diagram illustrating a second state of an engagement process of the driving assembly and the driving shaft in an image forming apparatus according to the first embodiment of the present invention.

As shown in FIG. 5, the urging portion 12 is also provided with an urging surface 12*d* facing the axis of the body portion 7 and a force bearing portion 12*e*. When the process cartridge 1 is mounted in the image forming apparatus along a direction substantially parallel to the axis X, a guiding urging portion 11*a*1 disposed on the power receiving portion 11*a* abuts against and urges the front end 100*a* of the driving shaft 100. At this time, as shown in FIG. 6, the power receiving portion 11*a* applies a radial force toward the driving shaft 100 to urge the axis of the driving shaft 100 to be inclined relative to the axis of the body portion 7, and the axis of the driving shaft 100 changes from S1 to S2 in a plane with the same height as that of the power receiving portion 11*a*. At the same time, the front end 100*a* of the driving shaft 100 is abutted against the force bearing portion 12*e* on the urging portion 12 so that the urging portion 12 overcomes the elastic force of the elastic component 14 to move toward the outer side of the radial direction of the body portion 7, that is, the urging portion 12 is squeezed by the driving shaft 100 to move away from the axis S1 along the radial direction. When the driving shaft 100 is driven by a motor in the image forming apparatus to rotate along a direction N, a minimum arc length of the urging surface 12*d* of the urging portion 12 abutting against an outer surface of the driving shaft 100 is set to be longer than an arc length of the recess 100*b* of the driving shaft 100 so as to prevent the urging portion 12 from entering the recess 100*b* of the driving shaft 100. Along with further rotation of the driving shaft 100 along the direction N, the driving shaft 100 rotates until the recess 100*b* is opposite to the power receiving portion 11*a*. Under the action of the elastic potential energy accumulated by the elastic component 14, the urging portion 12 squeezes the driving shaft 100 and moves close to the axis S1 along the radial direction, thereby urging the recess 100*b* of the driving shaft 100 to be engaged with the power receiving portion 11*a*. Along with further rotation of the driving shaft 100 along the direction N, the power receiving portion 11*a* is abutted against a surface of the recess 100*b* as shown in FIG. 7. The driving shaft 100 transmits the driving force to the power receiving portion 11*a* by use of a position of the recess 100*b* abutting against the power receiving portion 11*a*, and the power receiving portion 11*a* drives the photosensitive drum to rotate along the direction N. At this time, the urging portion 12 always keeps abutting against the outer circumferential surface of the driving shaft 100 under the action of the elastic force of the elastic component 14. Therefore, during a rotation, the driving shaft 100 will not cause the recess 100*b* to be disengaged from the power receiving portion 11*a* due to its centrifugal force, thereby ensuring the transmission of the driving force. Further, the minimum arc length of the urging surface 12*d* is defined as larger than the maximum arc length of an opening of the recess 100*b* based on measurement performed in a circumferential direction of the body portion 7, and therefore a spacing is always maintained between the urging portion 12 and the recess 100*b* during the rotation of the driving shaft 100.

Figure 8:
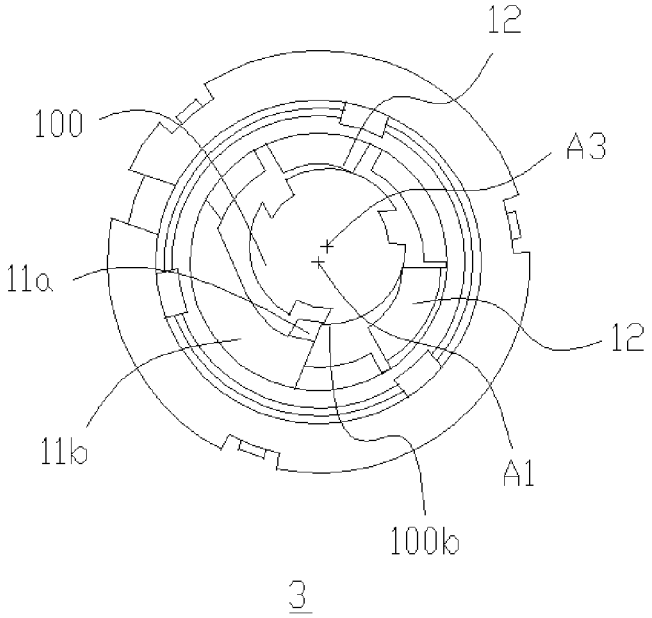
FIG. 8 is a schematic diagram of a disengagement of the driving assembly and the driving shaft according to the first embodiment of the present invention.

When the process cartridge 1 is removed from the image forming apparatus along a direction substantially parallel to the axis X, the power receiving portion 11*a* of the driving assembly 3 interferes with a part of the recess 100*b*, close to the front end 100*a*, of the driving shaft 100. At this time, as shown in FIG. 8, when an outer force continues acting on the process cartridge 1 to enable the power receiving portion 11*a* to squeeze the recess 100*b* of the driving shaft 100, because the power receiving portion 11*a* abuts against the recess 100*b* of the driving shaft 100 in a bevel-against-bevel manner, the power receiving portion 11*a* applies a radial component force to the driving shaft 100, and the driving shaft 100 is inclined relative to the axis of the body portion 7 under the action of the radial force applied by the power receiving portion 11*a*. The axis of the driving shaft 100 changes in a plane with the same height as that of the power receiving portion 11*a*, and the urging portion 12 is pressed by the driving shaft to move away from the axis S1 radially along with the offset of the driving shaft 100. During the radial offset of the driving shaft 100, the power receiving portion 11*a* is disengaged from the recess 100*b* of the driving shaft 100 and the driving shaft 100 will no longer interfere with the driving assembly 3. Thus, the process cartridge 1 may be smoothly removed from the image forming apparatus.

The Second Embodiment

Figure 9:
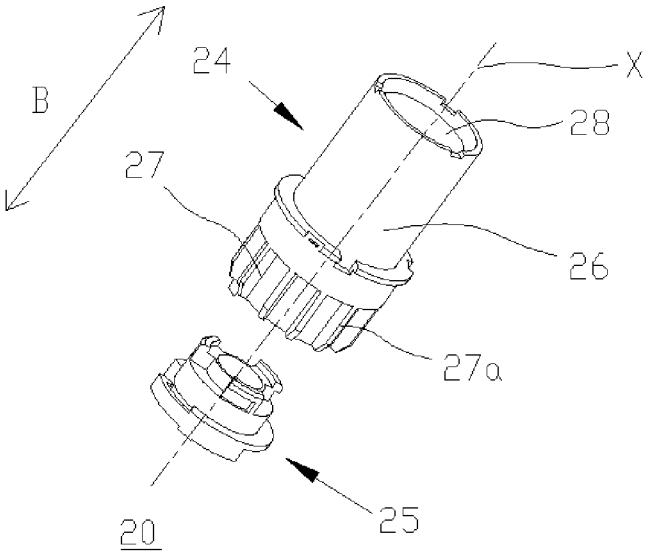
FIG. 9 is an exploded diagram of a driving assembly according to a second embodiment of the present invention.
Figure 10:
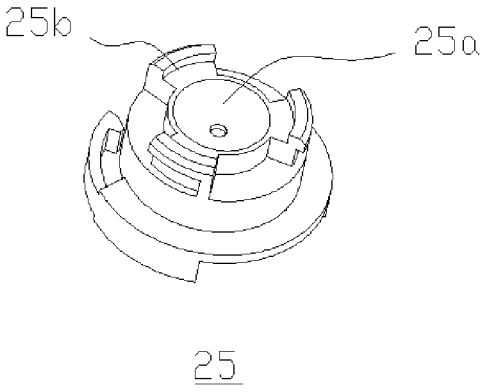
FIG. 10 is a schematic diagram illustrating a position member in the driving assembly according to the second embodiment of the present invention.
Figure 11:
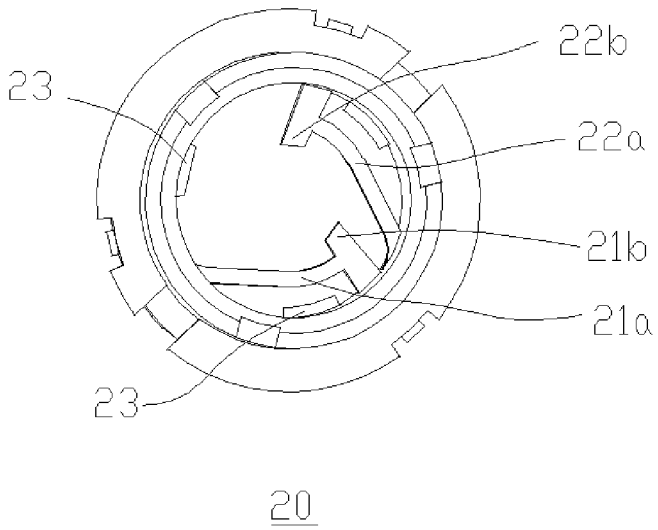
FIG. 11 is a schematic diagram illustrating a coupling member in the driving assembly according to the second embodiment of the present invention.

Descriptions will be made below to the second embodiment of the process cartridge of the present invention. In the embodiment, only technical features different from those of the first embodiment will be described without repeating those structures same as those in the first embodiment. As shown in FIGS. 9-11, a driving assembly 20 in the embodiment includes a position member 25 and a coupling member 24. The coupling member 24 is configured substantially as a cylindrical shape and may be engaged with a driving shaft 100 in the image forming apparatus so as to receive and transmit a driving force to a photosensitive drum, thereby driving the photosensitive drum to rotate. The coupling member 24 includes a body portion 26, a first power receiving portion 21*b*, a second power receiving portion 22*b*, a first reinforcing portion 21*a*, a second reinforcing portion 22*a* and a position boss 23. The body portion 26 is configured as a hollow cylindrical shape and has a first end 27 and a second end 28 at an axial direction B. An axial end of the first end 27 is disposed as a hole and an outer circumferential surface of the first end 27 is provided with a plurality of guiding ribs 27*a*. When the coupling member 24 is inserted into the photosensitive drum, the guiding ribs 27*a* may guide the insertion of the coupling member 24. Generally, to connect the coupling member 24 and the photosensitive drum more tightly, a proper amount of adhesive is further applied to the outer circumferential surface of the first end 27 to allow the first end 27 of the coupling member 24 to be bonded with the inner wall of the photosensitive drum and form tight mating. An axial end of the second end 28 is disposed as a hole. The first power receiving portion 21*b* is configured as a column extending toward an axis X in a radial direction from the body portion 26, and the body portion 26 is disposed substantially at the center of the coupling member 24 in an axial direction B. The second power receiving portion 22*b* is substantially same as the first power receiving portion 21*b* in shape, both of which are configured as columns extending toward the axis X from the body portion 26. The second power receiving portion 22*b* and the first power receiving portion 21*b* are located at different positions of the coupling member 24 along a circumferential direction and the first power receiving portion 21*b* and the second power receiving portion 22*b* are asymmetrically disposed at the body portion 26 relative to the axial direction B. The first power receiving portion 21*b* and the second power receiving portion 22*b* are both made of rigid material, unmovable relative to the body portion 26 and formed integrally with the body portion 26. The first reinforcing portion 21*a* extends from the body portion 26 and intersects with the first power receiving portion 21*b*, which can increase the strength of the first power receiving portion 21*b*. The second reinforcing portion 22*a* also extends from the body portion 26 and intersects with the second power receiving portion 22*b*, which can increase the strength of the second power receiving portion 22*b*. In the embodiment, three position bosses may be disposed and uniformly distributed in the circumferential direction of the body portion 26.

As shown in FIG. 10, the position member 25 is configured substantially as a boss shape and may be mounted at the first end 27 of the coupling member 24. By use of adhesive or a fastener or the like, the position member may be connected with the first end 27 of the coupling member 24, stably mounted in the circumferential inner wall of the first end 27 and thus seal the axial end of the first end 27 of the coupling member 24. In the embodiment, the position member 25 is provided with three position fasteners 25*b* which can be engaged with the position bosses 23 in the coupling member 24. Thus, the position member 25 can be connected into the coupling member 24. The position member 25 is further provided with a position groove 25*a* which is formed into a conic inward recess and located at the center of the position member 25. The position groove 25*a* is symmetrical relative to the axis X of the coupling member 24. In the embodiment, the driving assembly 20 is provided with the position member 25 to make the driving force transmission more stable. Alternatively, the position member 25 may also be omitted.

Descriptions will be made below to how the driving assembly 20 in the embodiment engages with the driving shaft 100 in the image forming apparatus and transmits a driving force in combination with accompanying drawings.

Figure 12:
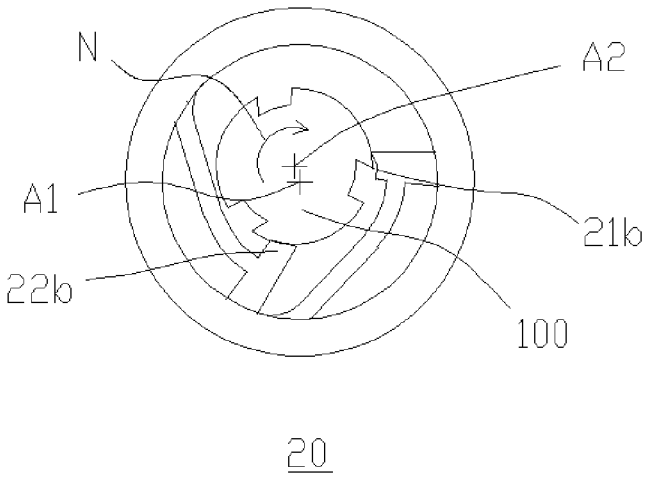
FIG. 12 is a schematic diagram illustrating a first state of the driving assembly and a driving shaft according to the second embodiment of the present invention.
Figure 13:
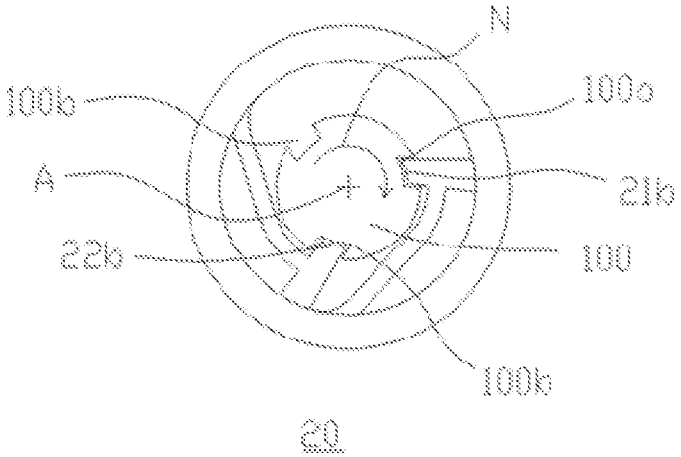
FIG. 13 is a schematic diagram illustrating a second state of the driving assembly and the driving shaft according to the second embodiment of the present invention.
Figure 14:
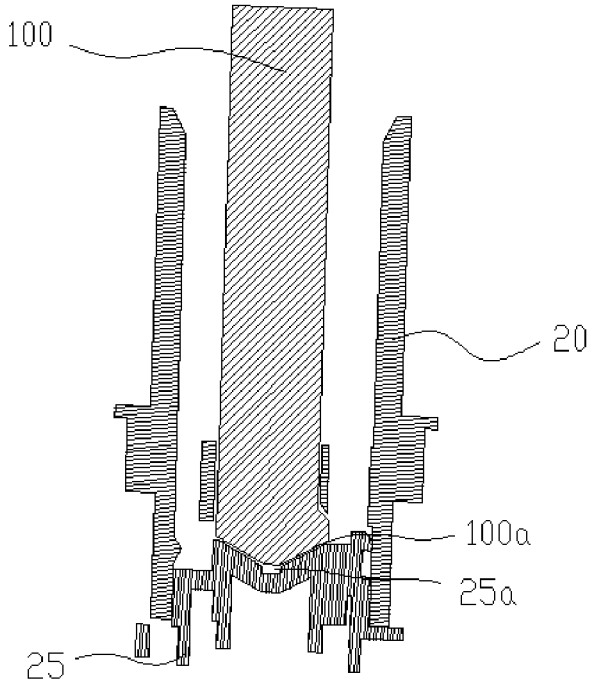
FIG. 14 is another sectional diagram of engagement of the driving shaft in an image forming apparatus and the driving assembly according to the second embodiment of the present invention.

When the process cartridge is mounted into the image forming apparatus along a direction substantially parallel to the axis X, the first power receiving portion 21*b* and the second power receiving portion 22*b* of the coupling member 24 are abutted against the circumferential surface of the driving shaft 100 and apply a force perpendicular to the axial direction to the driving shaft 100. In this case, the axis position of the driving shaft 100 offsets from S1 to S2 so that the coupling member 24 and the driving shaft 100 are in a state as shown in FIG. 12. The first power receiving portion 21*b* is abutted against the circumferential surface of the driving shaft 100 and the second power receiving portion 22*b* is abutted against the circumferential surface of the driving shaft 100. At this time, the driving shaft 100 and the coupling member 24 are in a non-engaged state. Next, the driving shaft 100 may be driven by the image forming apparatus to rotate along a direction N to the state shown in FIG. 13. At this time, the first power receiving portion 21*b* is located in the recess 100*b* of the driving shaft 100 and the second power receiving portion 22*b* is located in another recess 100*b* of the driving shaft 100 and the axis of the coupling member 20 and the axis of the driving shaft 100 are at the same position A. When the driving shaft 100 further rotates, the second power receiving portion 22*b* and the first power receiving portion 21*b* are engaged with the recesses 100*b* of the driving shaft, respectively so that the driving shaft 100 drives the coupling member 24 to rotate along the direction N. Because the photosensitive drum is coupled with the coupling member 24, the photosensitive drum is also driven to rotate. During the process of the driving force transmission, the driving shaft 100 and the position member 25 are in a state shown in FIG. 14. The front end 100*a* of the driving shaft 100 is configured as a conic shape, and the position groove 25*a* of the position member 25 receives and accommodates the front end 100*a* of the driving shaft 100. Because the position member 25 is fixed in the process cartridge and will not move, the position groove 25*a* limits the axial movement of the driving shaft 100 due to the abutting of the front end 100*a* of the driving shaft 100 and the position groove 25*a* even if the driving shaft 100 has a tendency to move toward a side of the position member 25 under the action of the elastic component during the driving force transmission. Therefore, the driving shaft 100 stably drives the driving assembly 20 to rotate.

The Third Embodiment

Figure 15:
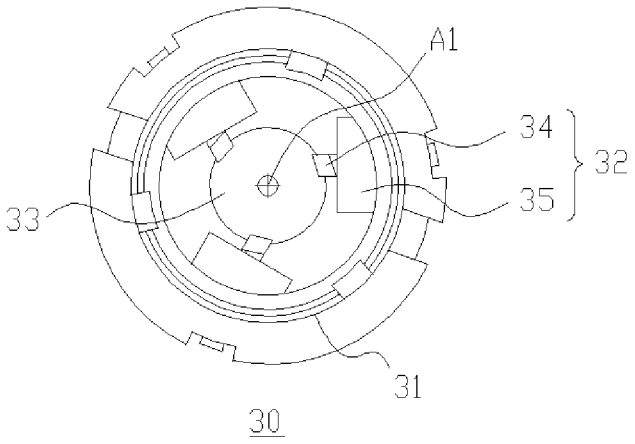
FIG. 15 is a schematic diagram illustrating a driving assembly according to a third embodiment of the present invention.
Figure 16:
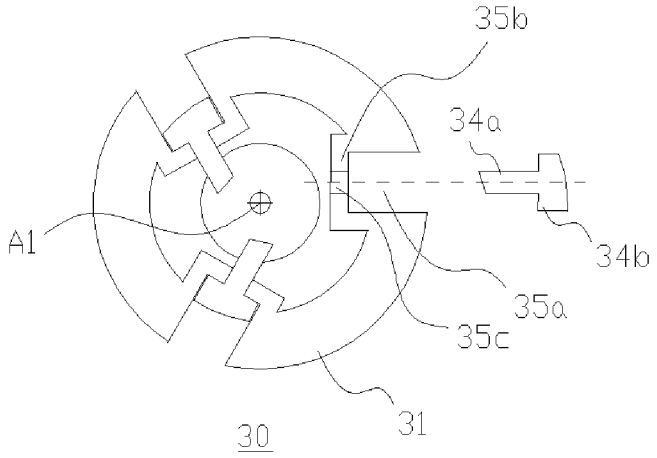
FIG. 16 is a sectional view of partial explosion of the driving assembly according to the third embodiment of the present invention.
Figure 17:
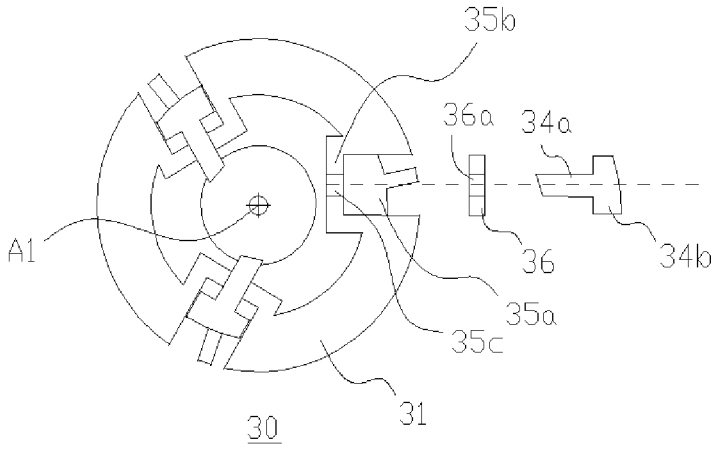
FIG. 17 is a mounting diagram of a magnetic component of the driving assembly according to the third embodiment of the present invention.

Descriptions will be made below to the third embodiment of the process cartridge of the present invention. As shown in FIGS. 15-17, a driving assembly 30 of the embodiment includes a body portion 31, a coupling member 32 and a position member 33. The driving assembly 30 may rotate around the axis X. The coupling member 32 includes a power receiving portion 34 and a supporting portion 35. The power receiving portion 34 is movably mounted in the supporting portion 35. The supporting portion 35 includes a groove 35*a* and a protrusion 35*b*. The groove 35*a* is an opening groove formed in the circumferential outer wall of the body portion 31 with its opening facing toward the outside of the body portion 31 along a radial direction. The protrusion 35*b* is a protrusion formed in the circumferential inner wall of the body portion 31 and radially facing toward the axis S1. The protrusion 35*b* and the groove 35*a* are integrally formed and a first opening 35*c* communicating with the groove 35*a* is formed on the protrusion 35*b*. The power receiving portion 34 includes an extension 34*a* and a limiting portion 34*b*. When the power receiving portion 34 is mounted into the supporting portion 35, the extension 34*a* passes through the groove 35*a*, the first opening 35*c* sequentially along a radial direction and moves toward the axis S1 until the limiting portion 34*b* abuts against a side surface of the protrusion 35*b* facing toward the groove 35*a*. That is, it indicates that the power receiving portion 34 is already mounted in the supporting portion 35. In the embodiment, the limiting portion 34*b* has the effect of limiting an amount that the extension 34*a* extends out of the first opening 35*c*.

In the embodiment, three coupling members 32 are provided and the power receiving portion 34 of the coupling member 32 is made of magnetic metal material. A magnetic component 36 sleeves the extension 34*a* of the power receiving portion 34. Specifically, a second opening 36*a* is formed on the magnetic component 36 and the extension 34*a* of the power receiving portion 34 passes through the second opening 36*a* so that the magnetic component 36 is abutted against the limiting portion 34*b* of the power receiving portion 34. When the power receiving portion 34 is mounted in the supporting portion 35, the magnetic component 36 is sandwiched between the limiting portion 34*b* of the power receiving portion 34 and the protrusion 35*b* of the supporting portion 35 along with the mounting of the power receiving portion 34 in the groove 35*a* of the supporting portion 35. Due to the magnetic force of the magnetic component 36, the power receiving portion 34 made of magnetic metal material may move radially in the first opening 35*c* under the attraction of the magnetic component 36. Optionally, the magnetic component 36 may also be disposed on the extension 34*b* of the power receiving portion 34 or the power receiving portion 34 is directly made of magnetic material so that the power receiving portion 34 moves radially in the first opening 35*c* due to mutual attraction of the power receiving portions 34. Optionally, the magnetic components 36 may also be disposed in the power receiving portion 34 and the supporting portion 35, respectively. The magnetic poles of the same property of the magnetic component 36 on the power receiving portion 34 and the magnetic component 36 on the supporting portion 35 are opposed each other so that the power receiving portion 34 can move radially in the first opening 35*c* through mutual repulsion of the magnetic components 36.

Figure 18:
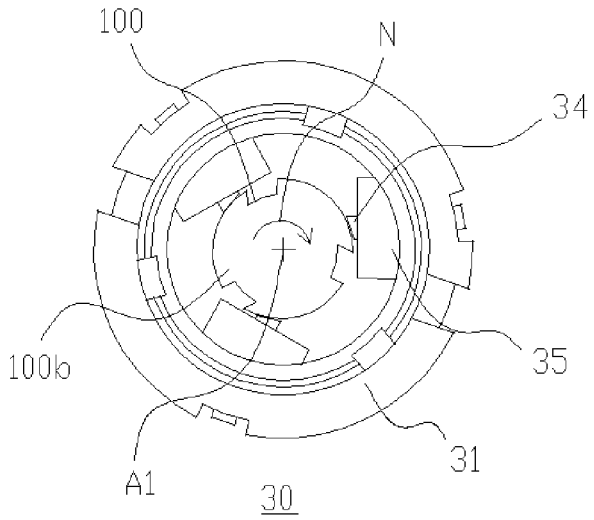
FIG. 18 is a schematic diagram illustrating a first state of the driving assembly and a driving shaft according to the third embodiment of the present invention.
Figure 19:
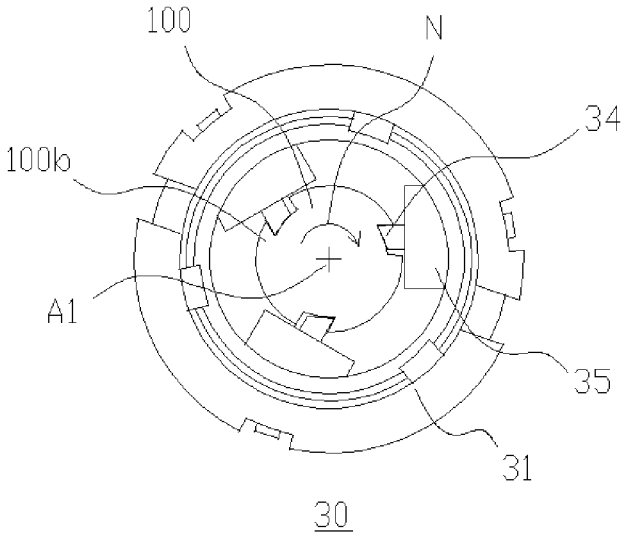
FIG. 19 is a schematic diagram illustrating a second state of the driving assembly and the driving shaft according to the third embodiment of the present invention.

When the process cartridge is mounted in the image forming apparatus along a direction substantially parallel to the axis X, the front end 100*a* of the driving shaft 100 is abutted against the extension 34*a* of the power receiving portion 34. At this time, as shown in FIG. 18, the driving shaft 100 applies a radial force to the power receiving portion 34 to urge the power receiving portion 34 to radially move away from the axis S1 in the supporting portion 35 until the front end 100*a* of the driving shaft 100 is accommodated in the position member 33. When the driving shaft 100 is driven by the motor in the image forming apparatus to rotate along a direction N, the circumferential surface of the driving shaft 100 further squeezes the power receiving portion 34 to enable the power receiving portion 34 to continue moving radially away from the axis S1. When the driving shaft 100 rotates until the recess 100*b* is opposite to the power receiving portion 34 as shown in FIG. 19, the power receiving portion 34 moves radially close to the axis S1 due to the attraction of the magnetic component 36 for the power receiving portion 34, thereby engaging with the recess 100*b* of the driving shaft. The driving shaft 100 is abutted against the power receiving portion 34 through the recess 100*b* to transmit the driving force to the power receiving portion 34 and drive it to rotate. The power receiving portion 34 further transmits the driving force to the driving assembly 30 to drive the photosensitive drum to rotate.

In the embodiment, when the process cartridge is removed and mounted, the power receiving portions 34 are always in a mutual attraction state due to the action of the magnetic components 36. Therefore, the power receiving portion 34 will not be squeezed by the driving shaft to depart from the supporting portion 35. Further, because the power receiving portion 34 is held by the first opening 35*c* of the supporting portion 35, when the power receiving portion 34 is driven by the driving shaft 100 to rotate, the centrifugal force applied by the driving shaft 100 to the power receiving portion 34 will not urge the power receiving portion 34 to depart from the supporting portion 35.

The Fourth Embodiment

Figure 20:
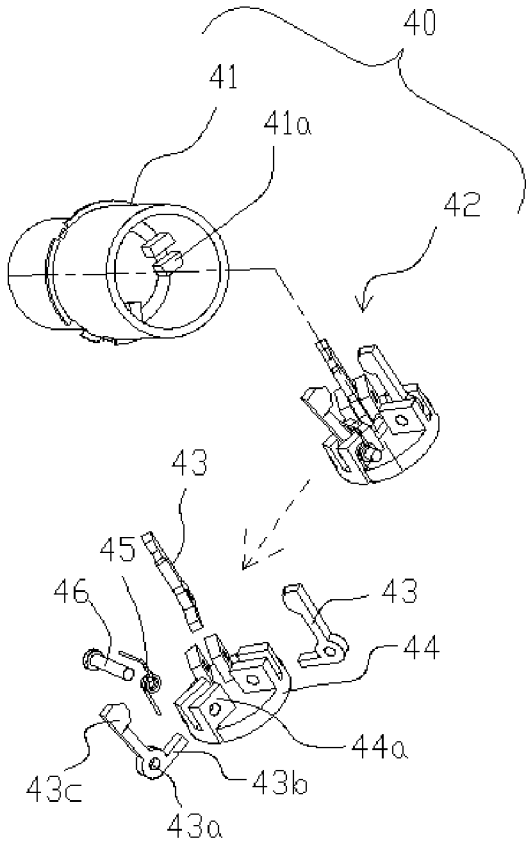
FIG. 20 is an exploded diagram of a structure of a driving assembly according to a fourth embodiment of the present invention.

Next, descriptions will be made below to the fourth embodiment of the present invention. As shown in FIG. 20, a driving assembly 40 in the embodiment includes a body portion 41 and a coupling assembly 42. The coupling assembly 42 is mounted in the body portion 41 and may drive the body portion 41 to rotate. The coupling assembly 42 includes a coupling member 43, a supporting bottom plate 44, a shaft pin 46 and an elastic member 45. The coupling member 43 is substantially of an L shape and includes a pressing portion 43*b* and a power receiving portion 43*c*. A rotation center 43*a* is disposed between the pressing portion 43*b* and the power receiving portion 43*c*. Three coupling member mounting portions 44*a* are distributed along the circumferential direction of the supporting bottom plate 44 in an equal distance. A pair of opposite-mounted ribs is disposed, and a mounting space is formed between the pair of mounting ribs. The pressing portion 43*b* of the coupling member 43 is mounted in the mounting space, and one shaft pin 46 penetrates through the mounting ribs, the rotation center 43*a* of the coupling member 43 and the elastic member 45 so that the coupling member 43 is rotatably mounted at the coupling member mounting portion 44*a*. The elastic member 45 in the embodiment is specifically configured as a torsional spring; one free end of the elastic member is abutted against the supporting bottom plate 44; the other free end of the elastic member is abutted against a side wall of the coupling member 43, and to reduce the space, the other free end is abutted against an inner side wall surface of the coupling member 43 along a circumferential direction of the supporting bottom plate 44, or the other free end is abutted against or connected with another position of the coupling member 43 selectively. After the elastic member 45 is mounted, the elastic force of the elastic member 45 pushes the power receiving portion 43*c* of the coupling member 43 outwardly from the circumferential direction of the driving assembly 40 so that the coupling member 43 rotates around the rotation center 43*a*. To facilitate mounting, a limiting portion (not shown) limiting outward rotation of the coupling member 43 is also disposed on the supporting bottom plate 44. After the coupling member 43 rotates outwardly for a certain distance, the limiting portion may limit the further outward rotation of the coupling member 43 by contacting with the coupling member 43. Optionally, since the coupling member 43 will be located in the hollow cylinder of the body portion 41 when the coupling assembly 42 is mounted in the body portion 41, the outward rotation of the coupling member 43 may be limited by use of the inner side wall of the body portion 41 without disposing the limiting portion on the supporting bottom plate 44. For simplified expression, the diagram only illustrates the elastic member and the shaft pin for one coupling member 43. It should be understood that all the coupling members 43 are provided with the elastic members and the shaft pins.

Figure 21:
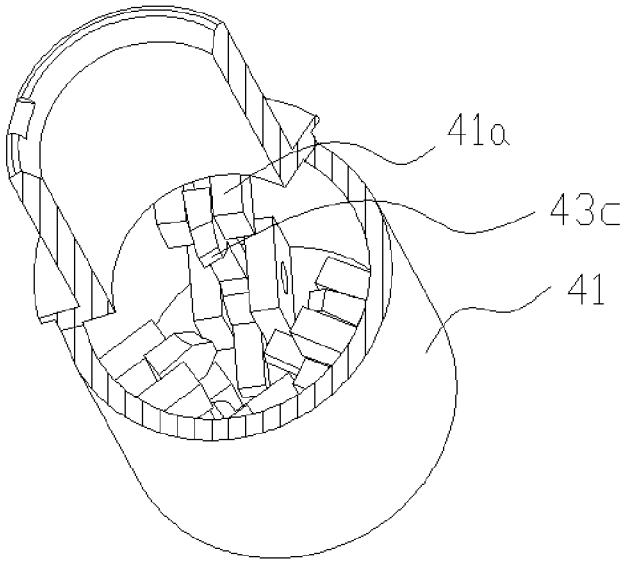
FIG. 21 is a schematic diagram of a local cutaway structure of the driving assembly according to the fourth embodiment of the present invention.

As shown in FIG. 21, a guiding portion 41*a* is disposed on the inner side surface of the body portion 41. The guiding portion 41*a* may guide the movement of power receiving portion 43*c* of the coupling member 43; the driving force received by the power receiving portion 43*c* from the image forming apparatus may also be transmitted to the body portion 41 through the guiding portion 41*a*, and thus the body portion 41 is driven to rotate. Optionally, the coupling member 43 may also transmit the driving force to the body portion 41 through the supporting bottom plate 44. Further, for convenience of mounting, the mounting portion of the coupling member 43 may be disposed in the supporting bottom plate 44. Optionally, the mounting portion may be disposed directly on the inner wall of the body portion 41 so that the coupling member 43 can be directly mounted on the inner wall of the body portion 41.

Figure 22:
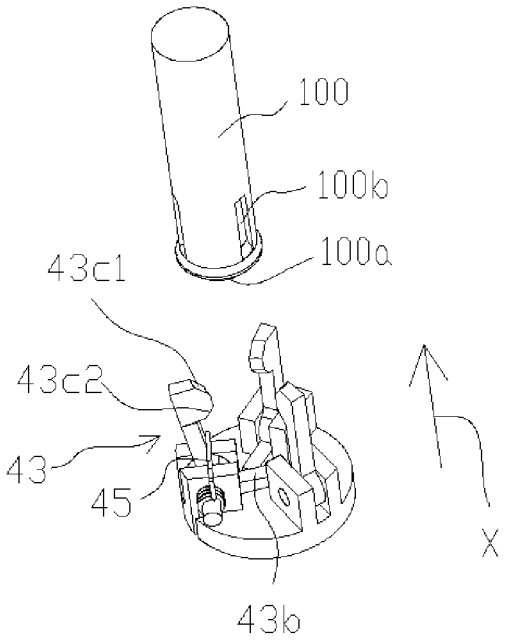
FIG. 22 is a schematic diagram of a structure before engagement of the driving assembly and a driving shaft in an image forming apparatus according to the fourth embodiment of the present invention.
Figure 23:
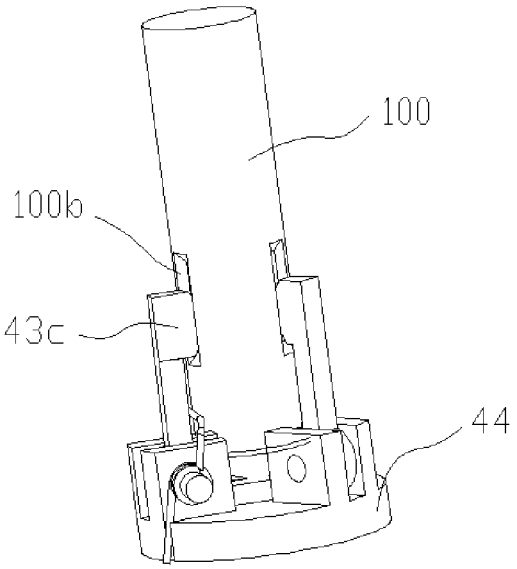
FIG. 23 is a schematic diagram of a structure during engagement of the driving assembly and the driving shaft in an image forming apparatus according to the fourth embodiment of the present invention.

As shown in FIG. 22, when the process cartridge is mounted into the image forming apparatus, the pressing portion 43*b* of the coupling member 43 is pressed by the front end 100*a* of a driving shaft 100 so that the coupling member 43 is rotated to be engaged with the recess 100*b* of the driving shaft 100, which will be described in detail below.

As shown in FIGS. 20-23, the process cartridge is mounted into the image forming apparatus along a direction X substantially parallel to the axis of the driving shaft 100. Before the coupling member 43 contacts with the driving shaft 100, the coupling member 43 is located at the position where the coupling member rotates outward under the bias pressure of the elastic member 45. For convenience of descriptions, the position where the coupling member 43 rotates outward is referred to as an opening position of the coupling member 43 hereinafter. When the coupling member 43 is at the opening position, the front end 100*a* of the driving shaft 100 will go over the power receiving portion 43*c* of the coupling member 43 to abut against the pressing portion 43*b* of the coupling member 43 so as to press the pressing portion. After receiving the pressing force from the driving shaft, the pressing portion 43*b* overcomes the elastic force of the elastic member 45 to rotate inward. After the process cartridge is mounted to a final position, the power receiving portion 43*c* is clamped into the recess 100*b* of the driving shaft 100 to complete engagement of the coupling member with the driving shaft 100. For convenience of descriptions, the position where the coupling member 43 rotates inward and finally stops to keep engagement with the recess 100*b* of the driving shaft 100 is referred to as a closing position of the coupling member 43. The driving shaft 100 transmits the rotational driving force to the driving assembly 40 through the engagement of the recess 100*b* and the power receiving portion 43*c*, and the driving assembly 40 then transmits the rotational driving force to different force bearing components in the process cartridge. The power receiving portion 43*c* has an inner-side guiding portion 43*c*2. When the process cartridge is to be removed, the inner-side guiding portion 43*c*2 is abutted against a closing end of the recess 100*b*, close to the front end 100*a*, of the driving shaft 100 to urge the coupling member 43 to move from the closing position to the opening position and finally disengage from the driving shaft 100. To mount the process cartridge more stably, an outer-side guiding portion 43*c*1 is disposed at a position that is on the power receiving portion 43*c* of the coupling member 43 and opposite to the inner-side guiding portion 43*c*2 in the embodiment. Due to the arrangement of the outer-side guiding portion 43*c*1, the coupling member 43 is enabled to further rotate outward through cooperation of the outer-side guiding portion 43*c*1 and the front end 100*a* of the driving shaft 100 in the case of insufficient distance of the outward rotation of the coupling member 43. In this case, the front end 100*a* of the driving shaft 100 can smoothly go over the power receiving portion 43*c*.

The Fifth Embodiment

Figure 24:
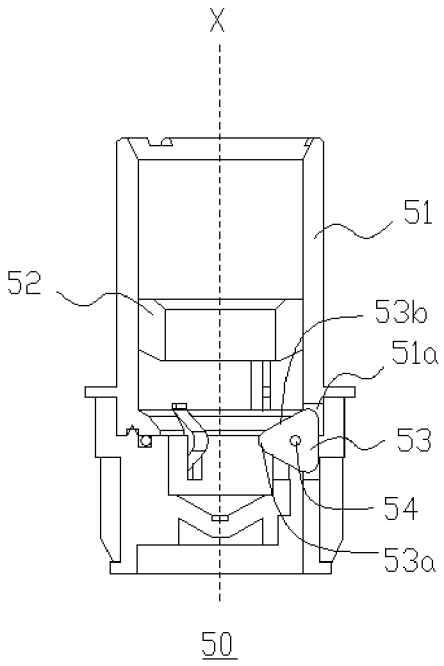
FIG. 24 is a sectional view of a driving assembly according to a fifth embodiment of the present invention.

Next, descriptions will be made below to the fifth embodiment of the process cartridge of the present invention. As shown in FIG. 24, a driving assembly 50 of the embodiment includes a body portion 51, a pressing portion 52 and a power receiving portion 53. The pressing portion 52 is movably disposed in the body portion 51. Specifically, the pressing portion 52 moves axially close to the circumferential inner wall of the body portion 51 along an axis X. Three power receiving portions 53 are disposed. In the embodiment, the power receiving portion 53 is configured as a triangular block including a tip 63*a* and a plane portion 53*b*. Three mounting grooves 51*a* are formed on the circumferential inner wall of the body portion 51. The power receiving portions 53 are mounted in the mounting grooves 51*a*, respectively through connecting pins 54 and may rotate around the connecting pins 54.

Figure 25:
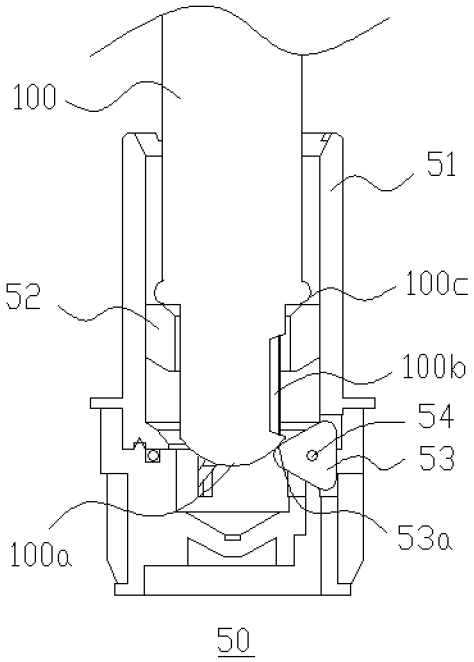
FIG. 25 is a schematic diagram illustrating a first state at which a driving assembly and a driving shaft are according to a fifth embodiment of the present invention.
Figure 26:
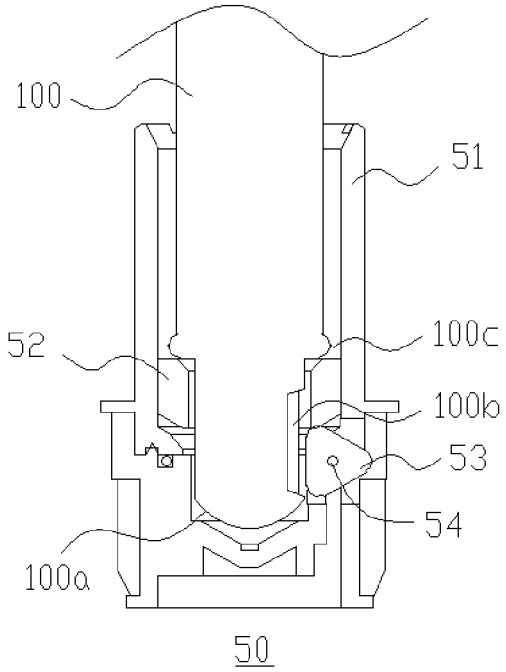
FIG. 26 is a schematic diagram illustrating a second state at which a driving assembly and a driving shaft are according to a fifth embodiment of the present invention.
Figure 27:
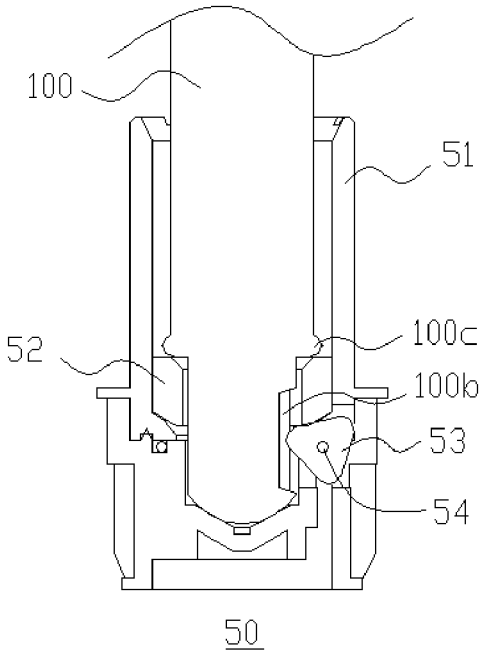
FIG. 27 is a schematic diagram illustrating a third state at which a driving assembly and a driving shaft are according to a fifth embodiment of the present invention.

As shown in FIGS. 25-27, when the process cartridge is mounted into the image forming apparatus along a direction substantially parallel to the axis X, the driving shaft 100 in the image forming apparatus is combined with the driving assembly 50. As the driving shaft 100 protrudes into the body portion 51, a raise 100*c* of the driving shaft 100 is abutted against the pressing portion 52, and the pressing portion 52 is pressed to move close to the power receiving portion 53 along the axis X. The front end 100*a* of the driving shaft 100 is abutted against the tip 53*a* of the power receiving portion 53 to urge the power receiving portion 53 to rotate around the connecting pin 54 while avoiding the position interfering with the front end 100*a*, that is, the power receiving portion 53 is rotated until the plane portion 53*b* is opposite to the driving shaft 100. It should be noted that when the original state of the power receiving portion 53 is that the plane portion 53*b* is opposite to the driving shaft 100, the front end 100*a* of the driving shaft 100 will not contact with the power receiving portion 53. As the driving shaft 100 further protrudes into the body portion 51, the driving shaft 100 presses the pressing portion 52 to enable the pressing portion 52 to be abutted against the power receiving portion 53 so that the power receiving portion 53 is urged to rotate around the connecting pin 54. At this time, if the recess 100*b* of the driving shaft 100 is opposite to the power receiving portion 53, the power receiving portion 53 is pressed by the pressing portion 52 to rotate until the tip 53*a* is engaged with the recess 100*b* of the driving shaft 100. When the driving shaft 100 is driven to rotate by the motor in the image forming apparatus, the driving assembly 50 receives the driving force from the driving shaft 100 through the power receiving portion 53 for rotation. When the circumferential surface of the driving shaft 100 is opposite to the power receiving portion 53, the power receiving portion 53 is always pressed by the pressing portion 52. When the driving shaft 100 is driven to rotate by the motor in the image forming apparatus and the recess 100*b* of the driving shaft 100 rotates to be opposite to the power receiving portion 53, the power receiving portion 53 pressed by the pressing portion 52 rotates until the tip 53*a* is engaged with the recess 100*b* of the driving shaft 100. The driving assembly 50 receives the driving force from the driving shaft 100 through the power receiving portion 53 for rotation.

In the above embodiments 3-5, the power receiving portion in the coupling member is made as movable relative to the body portion. Specifically, in the embodiment 3, the power receiving portion is configured to move in a radial direction of the body portion relative to the body portion. But the moving direction of the power receiving portion relative to the body portion is not limited to the radial direction, for example, the power receiving portion may move in a direction forming an included angle with the radial direction of the body portion. In the embodiments 4 and 5, the power receiving portion is configured to rotate relative to the body portion around a supporting point in the radial direction of the body portion. But the rotation direction of the power receiving portion is not limited to the radial direction of the body portion, for example, the power receiving portion may rotate in a direction forming an included angle with the radial direction of the body portion. The differences of the above solution from the prior art are that the power receiving portion entirely moves relative to the body portion and the power receiving portion and the body portion are not connected through an elastic member of a thin wall structure. In this case, the technical problem that the elastic member connecting the power receiving portion and the body portion is damaged due to excessive torsional force when the power receiving portion transmits the driving force to the body portion is avoided, and the processing difficulty and manufacturing cost of the coupling member are reduced at the same time.

Preferably, the power receiving portion and the body portion may be integrally formed directly, and the supporting portion between the power receiving portion and the body portion for supporting the power receiving portion directly adopts the form of fixed supporting, which may greatly reduce the manufacturing costs of the coupling member. At the same time, when the power receiving portion engages with the driving shaft in the image forming apparatus and transmits the driving force to the body portion, the coupling member will not be damaged due to excessive torsional force. Compared with the prior art, the driving assembly according to the present invention does not have the structure with a thin part, and the molding process of the driving assembly is simple without requiring complex processing technique of including metal pieces in the plastic pieces. In this way, the processing difficulty of the driving assembly is greatly reduced and the stability of the power transmission of the driving assembly is improved. Thus, the technical problems of complex molding process, high production costs and unstable transmission of the driving force of the driving assembly in the prior art are solved.

The above embodiments are used only for descriptions of the technical solution of the present invention rather than limiting the present invention. Although detailed descriptions are made to the present invention in combination with the preceding embodiments, those skilled in the art shall understand that any modifications may be made to the technical solutions recorded in the above embodiments or equivalent substitutions are made to partial technical features therein. These modifications and substitutions will not depart the essence of the corresponding technical solution from the spirit and scope of the technical solution of different embodiments of the present invention.

The foregoing description of the exemplary embodiments of the present invention has been presented only for the purposes of illustration and description and is not intended to be exhaustive or to limit the present invention to the precise forms disclosed. Many modifications and variations are possible in light of the above teaching.

The embodiments were chosen and described in order to explain the principles of the present invention and their practical application so as to activate others skilled in the art to utilize the present invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A process cartridge, detachably mounted in an image forming apparatus having a driving shaft, the driving shaft comprising a closed front end and a plurality of recesses arranged on a circumferential surface of the driving shaft, the process cartridge comprising: a driving assembly, comprising a body portion and a coupling member connected with the body portion, the coupling member being engaged with the driving shaft to receive a driving force; wherein the body portion comprises a hollow cylinder portion accommodating the driving shaft, wherein the coupling member has a pressing portion and a power receiving portion, and the pressing portion is pressed by the front end to drive the power receiving portion to move to engage with the plurality of recesses, and the coupling member is rotatable with respect to the body portion.

2. The process cartridge according to claim 1, the pressing portion and the power receiving portion are disposed at both sides with respect to the rotation center.

3. The process cartridge according to claim 1, wherein the coupling member is mounted on the driving assembly through a connecting pin and the coupling member rotates around the connecting pin.

4. The process cartridge according to claim 1, wherein the driving assembly further comprises one pair of oppositely-disposed mounting ribs and the coupling member is mounted in a space formed by the pair of mounting ribs.

5. The process cartridge according to claim 1, wherein the driving assembly further comprises a limiting portion for limiting outward rotation of the power receiving portion.

6. The process cartridge according to claim 5, wherein the body portion is fixedly connected with a photosensitive drum in the process cartridge and the coupling member transmits the driving force to the body portion through a supporting bottom plate so as to rotate the photosensitive drum.

7. The process cartridge according to claim 1, wherein when the pressing portion is pressed by the front end to allow the power receiving portion to be abutted against the circumferential surface of the driving shaft during the process of mounting the process cartridge in the image forming apparatus, the power receiving portion enters one of the plurality of recesses and engages with the recess through rotation of the driving shaft.

8. The process cartridge according to claim 1, wherein the power receiving portion has an inner-side guiding portion, and the inner-side guiding portion is abutted against a closed end, close to the front end, of one of the plurality of recesses of the driving shaft to urge the power receiving portion to rotate and disengage from the driving shaft when the process cartridge is removed from the image forming apparatus.

9. The process cartridge according to claim 1, wherein the driving assembly further comprises a supporting bottom plate mounted on the body portion and the coupling member is movably mounted on the supporting bottom plate.

10. The process cartridge according to claim 9, wherein three coupling member mounting portions are arranged in an equal distance along a circumferential direction of the supporting bottom plate and three coupling members are mounted on the three coupling member mounting portions, respectively.

11. The process cartridge according to claim 1, wherein the driving assembly further comprises a supporting bottom plate and an elastic member, one end of the elastic member is abutted against the supporting bottom plate and the other end is abutted against the coupling member.

12. The process cartridge according to claim 1, wherein the coupling member is substantially of an L shape and the pressing portion and the power receiving portion are located on both ends of the L shape, respectively.

13. The process cartridge according to claim 1, wherein the power receiving portion locates in a region formed between an inner wall of the hollow portion and the driving shaft when the power receiving portion and the driving shaft are engaged.

14. The process cartridge according to claim 1, wherein when the process cartridge is installed into the image forming apparatus along a direction parallel to the rotational axis direction of the body portion, the closed front end and the plurality of recesses enter into the cylinder portion.

15. A process cartridge, detachably mounted in an image forming apparatus having a driving shaft, the driving shaft comprising a closed front end and a plurality of recesses arranged on a circumferential surface of the driving shaft, the process cartridge comprising: a driving assembly, comprising a body portion and a coupling member connected with the body portion, the coupling member being engaged with the driving shaft to receive a driving force; wherein the coupling member has a pressing portion and a power receiving portion, and the pressing portion is pressed by the front end to drive the power receiving portion to move to engage with the recess;

the driving assembly further comprises a supporting bottom plate and an elastic member, one end of the elastic member is abutted against the supporting bottom plate and the other end is abutted against the coupling member;

the driving assembly further comprises a supporting bottom plate and an elastic member, one end of the elastic member is abutted against the supporting bottom plate and the other end is abutted against the coupling member; and the body portion comprises a hollow portion accommodating the driving shaft, and the elastic member urges the power receiving portion to abut against an inner side wall of the hollow portion during the process of mounting the process cartridge in the image forming apparatus.

* * * * *